United States Patent [19]

Karlsson et al.

[11] Patent Number: 4,874,467

[45] Date of Patent: Oct. 17, 1989

[54] METHOD OF CONTROLLING CROSS PROFILE OF PROPERTIES OF PAPER WEB

[75] Inventors: Håkan I. Karlsson, Åkersbergo; Inge J. Lundqvist, Spånga; Bengt Y. Härdin, Hägersten; Thomas L. Östman, Sp522 nga,all of Sweden

[73] Assignee: Svenska Traforskningsinstitutet, Sweden

[21] Appl. No.: 86,195

[22] Filed: Aug. 14, 1987

Related U.S. Application Data

[63] Continuation of Ser. No. 438,573, Nov. 1, 1982, abandoned, which is a continuation of Ser. No. 264,838, May 18, 1981, abandoned.

[30] Foreign Application Priority Data

Jun. 2, 1980 [SE] Sweden ..... 8004084

[51] Int. Cl.[4] ..... D21F 1/02; D21F 7/00; D21F 9/02

[52] U.S. Cl. ..... 162/198; 162/253; 162/259; 162/DIG. 6; 162/DIG. 11; 364/471

[58] Field of Search ..... 162/252, 253, 258, 263, 162/198, DIG. 11, 259, DIG. 6; 364/471

[56] References Cited

U.S. PATENT DOCUMENTS

| | | | |
|---|---|---|---|
| 3,610,899 | 10/1971 | Dahlin | 162/DIG. 11 |
| 3,767,900 | 10/1973 | Chao | 162/DIG. 11 |
| 3,989,085 | 11/1976 | Crosby | 162/DIG. 11 |
| 4,152,202 | 5/1979 | Deligt | 162/253 |

FOREIGN PATENT DOCUMENTS 2025088 1/1980 United Kingdom .

*Primary Examiner*—Steve Alvo

*Attorney, Agent, or Firm*—Lerner, David, Littenberg, Krumholz & Mentlik

[57] ABSTRACT

A method of controlling the properties of a paper web across the feed direction, i.e., cross profile, in a paper machine. The cross profile is adjusted in a plurality of setting positions across the web. Proceeding from a measured cross profile and desired cross profile, an optimum correction in the setting positions is calculated, so that the cross profile is brought into agreement with the desired one. At this calculation the circumstance is utilized, such that a disturbance in the stock in a certain setting position results in a corresponding change in the cross profile of the paper web.

9 Claims, 2 Drawing Sheets

METHOD OF CONTROLLING CROSS PROFILE OF PROPERTIES OF PAPER WEB

This is a continuation, of application Ser. No. 438,573 filed 11/01/82, now abandoned, which is a continuation of application Ser. No. 264,838, filed on 05/18/81, now abandoned.

BACKGROUND OF THE INVENTION

The present invention relates in general to the manufacture of paper in a paper machine, and more particularly, to the controlling in such paper machine the properties of a paper web across the feed direction thereof, i.e., cross profile.

In a paper machine, the paper web is formed by stock flowing out onto a wire from a nozzle provided in a head box. The stock is thereafter dewatered successively by subsequent pressing and drying such that a coherent web is obtained. The nozzle through which the stock flows is constructed from an upper lip and a lower lip. The stock flowing through the nozzle orifice is controlled by a device which lifts the upper lip in parallel across the entire width of the machine, and by adjusting members, such as screws, which are arranged in several setting positions across the web. By the adjusting members, the nozzle orifice can be adjusted on a smaller part of the web width for controlling the grammage of the web across the feed direction. The grammage in turn influences other properties, for example, thickness, dry weight and moisture content. These properties usually are measured after drying of the web and are recorded in the form of a so-called cross profile.

The cross profile can be adjusted also at positions other than in the nozzle orifice. The stock, for example, after flowing out of the nozzle orifice and onto the wire, can be affected in different ways. It is known, for example, that by directing air or liquid jets against the wire to disturb the stock flow, the cross profile of the web can be altered.

It has been found that a definite change in a certain setting position, for example, a definite change in the position of the upper lip or in the liquid jet, brings about a corresponding change in the cross profiles. Such response extends in a lateral direction beyond that web portion which corresponds to the web width of the setting position, as a disturbance in the stock also spreads across the feed direction. This situation creates serious problems when the cross profile is to be corrected. Accordingly, it is not sufficient to change the setting position which corresponds to the location in the cross profile where a change is required. Normally, one tries to find a solution with the assistance of experience and checks the result subsequently.

The above method has not been regarded as satisfactory, and several systems have been proposed for solving this problem, for example, as disclosed in U.S. Pat. Nos. 3,413,192 and 3,989,085. However, the above noted side effects and problems which arise when a given setting position is changed, have not sufficiently been taken into consideration and solved by these prior art systems.

Accordingly, there is an unsolved need for a method of controlling the properties of a paper web across the feed direction in a paper machine.

SUMMARY OF THE INVENTION

The present invention relates to a method for solving the above-mentioned problem. Specifically, in accordance with the present invention, it is possible from a measured cross profile to determine an optimum correction in the setting positions, so that the cross profile to the greatest possible extent can be brought into agreement with a desired cross profile. The profile can be corrected very rapidly by small control actions without causing instability thereof. The present invention can be applied both to manual and automatic control of the cross profile of the paper web.

In accordance with the present invention, there is described a method for controlling the cross profile of properties of a paper web across the feed direction thereof in a paper machine. The cross profile can be affected by several setting positions across the web in such a manner that a definite change in a setting position brings about a corresponding change in the cross profile. The method comprises measuring a cross profile in question and comparing with a desired cross profile; indicating the deviation between the cross profile in question and the desired cross profile in the form of a first error cross profile; comparing each of the responses from the setting positions with the first error cross profile whereby a calculated degree of agreement indicates the necessary mutual relative change in each setting position; calculating the necessary change in each setting position by the assistance of the responses from the setting positions, the desired cross profile and the measured cross profile in question, and determining thereafter a corresponding change; adding the corresponding thus determined change to the measured cross profile in question and comparing with the desired cross profile; and, utilizing the calculated necessary change in each setting position for adjustment in the setting positions.

BRIEF DESCRIPTION OF THE DRAWINGS

The above description as well as further objects, features, and advantages of the present invention will be more fully understood by reference to the following detailed description of a presently preferred, but nonetheless, illustrative paper web control method in accordance with the present invention when taken in conjunction with the accompanying drawings, wherein.

DETAILED DESCRIPTION

Figure 1:
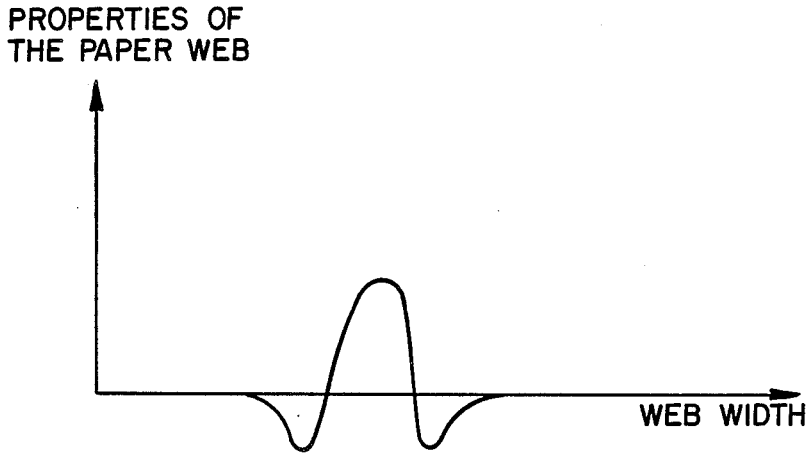
FIG. 1 shows how the cross profile is affected by a change in a setting position.

In order to control the properties of the paper web across the feed direction, it is necessary to know the response, i.e., the change in the cross profile at the web formation which is caused by a change in the setting position. It has been found that a certain change in a setting position at a certain operating condition results in the same change in the cross profile. It has also been found that different setting positions bring about substantially the same response. Near the web edge, however, slightly deviating responses can occur. In FIG. 1, an example of a response is shown which is caused by a change or disturbance in a setting position.

Figure 2:
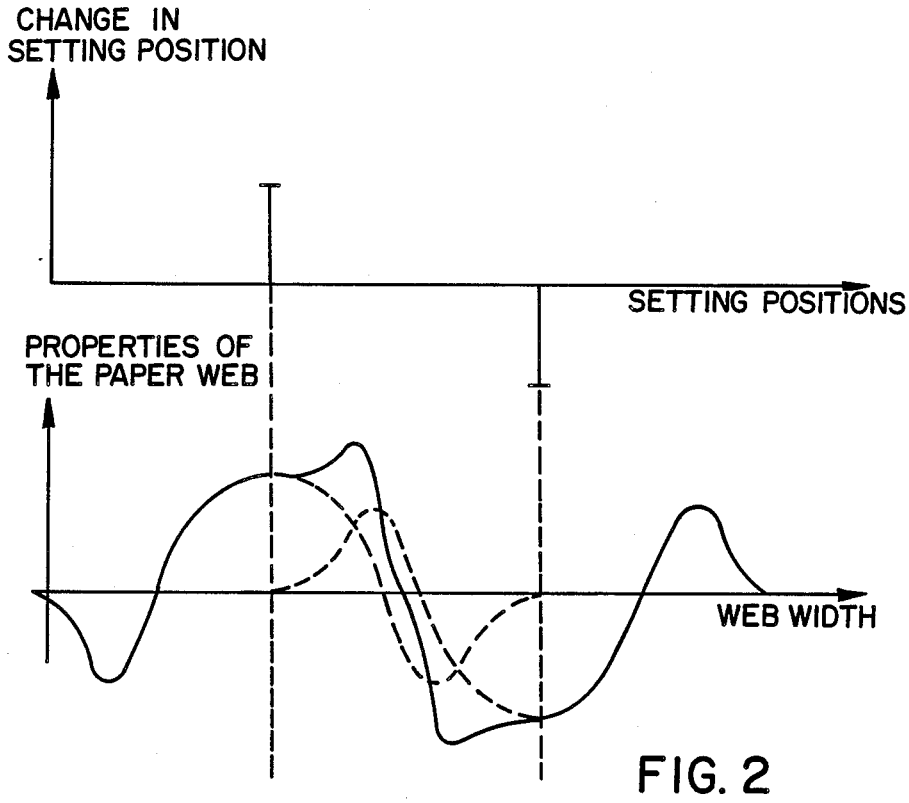
FIG. 2 shows how the cross profile is affected by changes in two setting positions.

As shown in FIG. 2, the change in the cross profile at changes in different setting positions is obtained as the total of the responses from the individual setting positions. The present invention will now be described in greater detail with reference to an embodiment where the different setting positions are represented by set screws, by which the upper lip of the nozzle can be adjusted.

Figure 3:
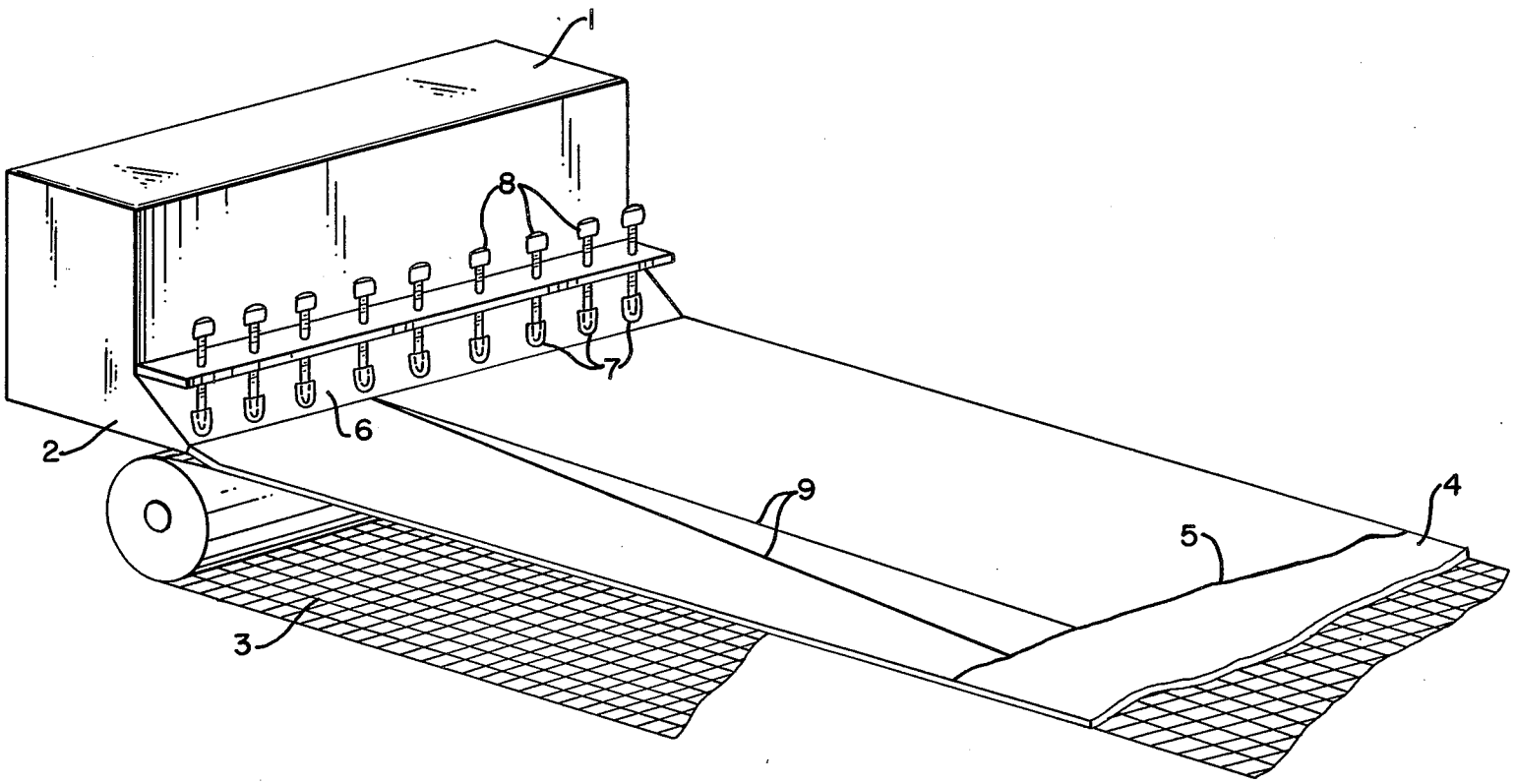
FIG. 3 is a perspective elevation showing the head box part in a paper machine.

Referring to the embodiment shown in FIG. 3, the stock is supplied through a head box 1. The stock flows out through a nozzle 2 to a wire 3 where the paper web 4 is formed and successively dewatered. At the wet line 5, the dewatering process has proceeded to such an extent that the free surface water disappears, and the positions of the fibres relative to each other are determined. The upper lip 6 of the nozzle can be adjusted in different positions 7 by means of set screws 8. A change in a setting position 7 results in a disturbance in the stock. This disturbance propagates also as wave fronts 9 across the machine direct on and are entirely "frozen" first at the wet line 5. Thereby, the aforementioned responses arise.

In the completed paper web, a certain cross profile for each property, for example, grammage or moisture content, is desired. An entirely straight profile is not necessarily desirable. For various reasons, it is desired for the profile to have a different shape. When the control is effected only by means of the upper lip 6 of the nozzle, all properties are affected by a change of a set screw 8. It is, therefore, scarcely possible to achieve the desired profile for all properties. The setting of the upper lip 6 must then be determined by a compromise between the different cross profiles desired. It is thus possible when the setting of the upper lip is being determined to attach different importance to different properties.

In accordance with the present invention, an error profile is determined which consists of the difference between the cross profile in question and the desired cross profile. Weighting between different properties is preferably carried out by multiplying the error profile with a profile of weights, whereby a weighted error profile is obtained.

The responses being known, it is possible to determine the mutual relative change required for each set screw 8 by multiplying the error profile with the response locally about the position corresponding to each set screw and thereafter summing up the results. When the total is zero, a change of the set screw has no effect on the error profile in this position. When the total is significantly different from zero, control effect can be obtained. The higher the absolute value of the total, the greater is the control effect obtained. By repeating the multiplication and summing up for different screws in succession, the relative set screw adjustment is determined.

From the mutual relative set screw change thus determined, the absolute change of the set screws 8 can be calculated with the assistance of the responses, the desired cross profile and the measured cross profile. This is carried out so that from the relative set screw change, first the corresponding relative cross profile change is calculated by assistance of the responses. The absolute cross profile change is an amplifying factor (k) times the relative cross profile change. The factor k is calculated by minimizing the difference between the desired profile and the measured profile +k·relative profile change. By the assistance of the amplifying factor (k) thus calculated, the necessary absolute change of the set screws as k·relative change is obtained.

After having produced the necessary adjustment of the set screws 8, the resulting cross profile change can be determined. This change of the cross profile is added to the measured cross profile. The total represents the new cross profile, which would be the result of an adjustment of the set screws 8 according to the change calculated in accordance with the above method. A comparison with the desired cross profile shows a deviation, which is indicated in the form of a new error profile. When the deviation is not too great, the set screws 8 can be adjusted directly in accordance with the calculated necessary changes. When the deviation still is great, the new wrong profile can be utilized for a new calculation and control according to the above until the deviation is acceptable. First thereafter the set screws 8 are adjusted.

When several properties of the paper web have to be taken into consideration, a nozzle setting is desired which yields the smallest total deviation from the desired cross profiles. This can be accomplished by minimizing the below function, V, where each term represents a certain property of the web, for example thickness, dry weight and moisture content. Also, the upper lip position can be included as a term for preventing the curvature of the upper lip from becoming too great.

$$V=(a_1 \cdot P_1)^2+(a_2 \cdot P_2)^2+(a_3 \cdot P_3)^2+\ldots$$

where $a_1$, $1_2$, $a_3$, . . . =profiles of weights which determine the weights to be attached to a certain property of the paper web and the variation of the property across the web.

$P_1$, $P_2$, $P_3$, . . . =error profiles for every property of the paper web and, respectively, position of the upper lip.

The square totals of different error profiles are weighted together, and the total sum is minimized. V is a function having as many dimensions as setting positions 7 by set screws 8. The object being to attain a setting of the set screws 8 where every change of a set screw will result in an increase of the function V.

Different importance can also be attached to the different setting positions 7, preferably by multiplying the calculated mutual relative set screw change with a weight factor, before the calculation is continued according to the above. The nozzle 2 and the cross profiles can hereby be contolled in the way desired. When, for example, certain set screws 8 should not be touched, these screws can be excluded from the function by setting their weights equal to zero.

The above example has proceeded from the assumption that the setting positions 7 consisted of set screws 8 in the nozzle. The responses effected by changes in the set screws are relatively wide. This implies difficulties, for example, when error profiles containing narrow streaks are to be remedied. Such streaks, however, can be affected when the setting positions are spaced from the nozzle closer to the wet line 5. The closer the setting position is to the wet line, the response from such a setting position becomes narrower.

Special advantages can be obtained by using setting positions both at the nozzle and farther ahead on the wire. Adjustment in the nozzle is good for long waves in the cross profile, while adjustment in setting positions on the wire is good for short waves. The cross profile then can advantageously be divided into two components by low-pass (LP) and high-pass (HP) filtrations. The nozzle then controls on the LP part, and the other setting members control on the HP part. Another alternative is to alternatingly make changes in the setting positions in the nozzle and along the wire for the adjustment and in this way take into consideration the long waves as well as the short waves in the cross profile.

Although the invention herein has been described with reference to particular embodiments, it is to be understood that these embodiments are merely illustrative of the principles and application of the present invention. It is to be understood that numerous modifications may be made in the illustrative embodiments and other arrangements may be devised with departing from the spirit and scope of the present invention as defined by the appended claims.

What is claimed is:

1. A method of controlling a cross profile of properties of a paper web across a feed direction thereof in a paper machine, wherein said cross profile can be affected by several setting positions across the web in such a manner that a definite change in a setting position brings about a corresponding response in said cross profile, said response extending in a lateral direction beyond that web portion which corresponds to the web width of the setting, said method comprising the steps of:

measuring an actual cross profile and comparing with a desired cross profile;

indicating a deviation between the measured cross profile and the desired cross profile in the form of a first error cross profile;

comparing each of the responses from the setting positions by turn with the first error cross profile for determining necessary mutual relative change in each setting position by multiplying the first error profile with the response locally about each setting position and summing up the result;

calculating the corresponding necessary relative change in the cross profile from said determined necessary relative change in each setting position by means of the responses;

determining an amplifying factor (k) by minimizing the difference between the desired cross profile and the measured cross profile added to the result of k multiplied with the necessary relative cross profile change;

calculating necessary absolute change in each setting position as k corresponding relative change;

determining the resulting change in cross profile by means of the responses;

adding said determined change in cross profile to the measured cross profile and comparing with the desired cross profile to determine a deviation which constitutes a second error cross profile;

repeating the method with said second error cross profile if the deviation is greater than a predetermined degree; and utilizing the calculated necessary absolute change in each setting position for adjustment in the setting positions.

2. The method as defined in claim 1 wherein the paper web is formed by outflow of a stock through a nozzle, and the flow through the nozzle is controlled in each setting position.

3. The method as defined in claim 1 wherein the paper web is formed on a wire, whereafter it is affected in setting positions along the web where free surface water is still visible on the web.

4. The method as defined in claim 1 wherein the paper web is formed, in that a stock flows out onto a wire through a nozzle and the web is affected in setting positions both in the nozzle and along the web.

5. The method as defined in claim 4 wherein the cross profile of the properties is divided into two components by low-pass (LP) and high-pass (HP) filtrations, in such a manner, that the setting positions in the nozzle control on the LP part, and the setting positions along the web control on the HP part.

6. The method as defined in claim 4 wherein the cross profile of properties is controlled by alternatingly making changes in the setting positions in the nozzle and in the setting positions along the web.

7. The method as defined in claim 1 in that consideration is made to different properties of the paper web, in that the first error profile is calculated as a weighted error profile by multiplication with a profile of weights which determines the weights to be attached to the different properties across the web direction.

8. The method as defined in claim 1 wherein the paper web is formed by outflow of a stock through a nozzle and the flow is controlled by movement of an upper lip of the nozzle in the different setting positions, and that the position of the upper lip is indicated and weighted together with the different properties of the paper web for resricting the deflection of the upper lip.

9. The method as defined in claim 1 in that different weights are attributed to the different setting positions, in that the calculated change in each setting position is multiplied by a factor of weights, before the calculation is continued.

* * * * *

UNITED STATES PATENT AND TRADEMARK OFFICE

CERTIFICATE OF CORRECTION

PATENT NO. : 4,874,467

DATED : October 17, 1989

INVENTOR(S) : Karlsson et al.

It is certified that error appears in the above-identified patent and that said Letters Patent is hereby corrected as shown below:

In the Inventors, line 4, "Sp522" should read --Spånga--.
In the Abstract, line 5, between "and" and "desired", insert --a--.
Column 3, line 20, "direct on" should read --direction--.

Signed and Sealed this

Twenty-fifth Day of December, 1990

*Attest:*

HARRY F. MANBECK, JR.

*Attesting Officer*

*Commissioner of Patents and Trademarks*